US007090399B2

(12) United States Patent
Godshaw et al.

(10) Patent No.: US 7,090,399 B2
(45) Date of Patent: Aug. 15, 2006

(54) BAG WITH WIRE FRAME CONSTRUCTION

(75) Inventors: Donald E. Godshaw, Evanston, IL (US); Andrejz M. Redzisz, Wheeling, IL (US)

(73) Assignee: Travel Caddy, Inc. D/B/A Travelon, Elk Grove Village, IL (US)

( * ) Notice: Subject to any disclaimer, the term of this patent is extended or adjusted under 35 U.S.C. 154(b) by 260 days.

(21) Appl. No.: 10/464,955

(22) Filed: Jun. 19, 2003

(65) Prior Publication Data

US 2004/0258331 A1 Dec. 23, 2004

(51) Int. Cl.
*B65D 33/02* (2006.01)

(52) U.S. Cl. ..... 383/119; 383/84; 190/122; 190/127

(58) Field of Classification Search ..... 383/119, 383/34.1, 84, 34; 150/119, 130, 10; 190/122, 190/123, 127, 107, 115; 220/9.1–9.4; 206/581
See application file for complete search history.

(56) References Cited

U.S. PATENT DOCUMENTS

| | | | | | |
|---|---|---|---|---|---|
| 1,040,300 | A | * | 10/1912 | Fitzgerald | 190/107 |
| 2,146,658 | A | * | 2/1939 | Stanley | 156/222 |
| 2,191,557 | A | * | 2/1940 | Cline | 190/106 |
| 5,009,189 | A | * | 4/1991 | Neff | 119/200 |
| 5,117,952 | A | * | 6/1992 | Suh | 190/127 |
| 6,102,569 | A | * | 8/2000 | Wang | 383/104 |

FOREIGN PATENT DOCUMENTS

| | | | | |
|---|---|---|---|---|
| FR | 1.201.167 | * | 12/1959 | 383/119 |
| GB | 2 184 940 A | * | 7/1987 | 190/107 |

* cited by examiner

*Primary Examiner*—Jes F. Pascua
(74) *Attorney, Agent, or Firm*—Banner & Witcoff, Ltd.

(57) ABSTRACT

A rectangular parallelepiped carrying case is fabricated from a fabric or other flexible material and includes at least three wire rod reinforcement members extending between lateral sides of the carrying case generally adjacent at least two of the top peripheral edges forming the carrying case. The wire rods are retained by an extra layer of fabric which effectively encapsulates the wire rods or rigid members that extend between opposite lateral sides of the carrying case.

1 Claim, 5 Drawing Sheets

44
46
44
22
20
24
12
26
28
16
38
30
36
32
34
40
10
18
14

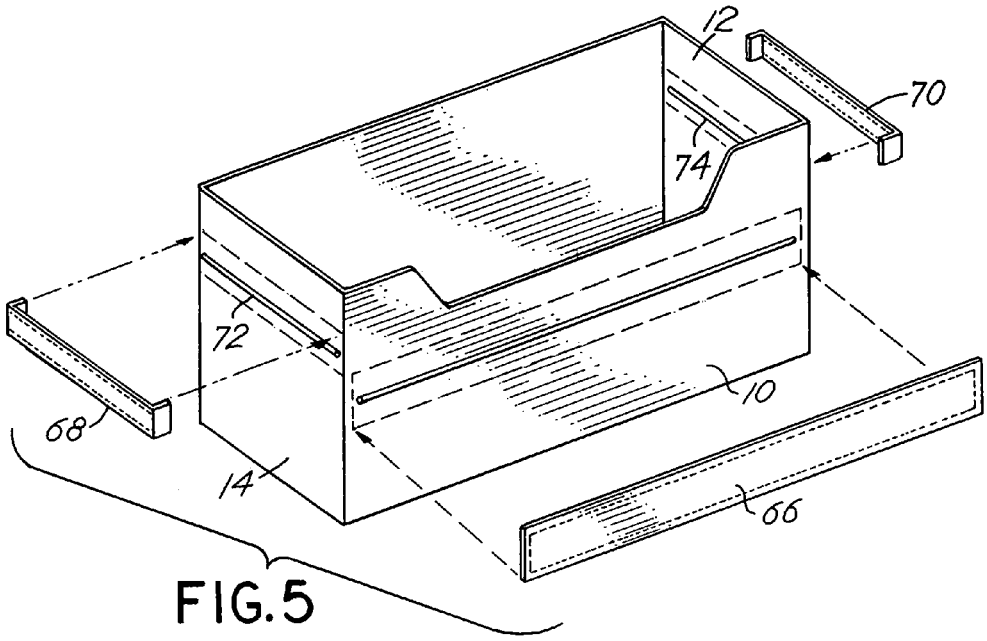
FIG.5
FIG.6
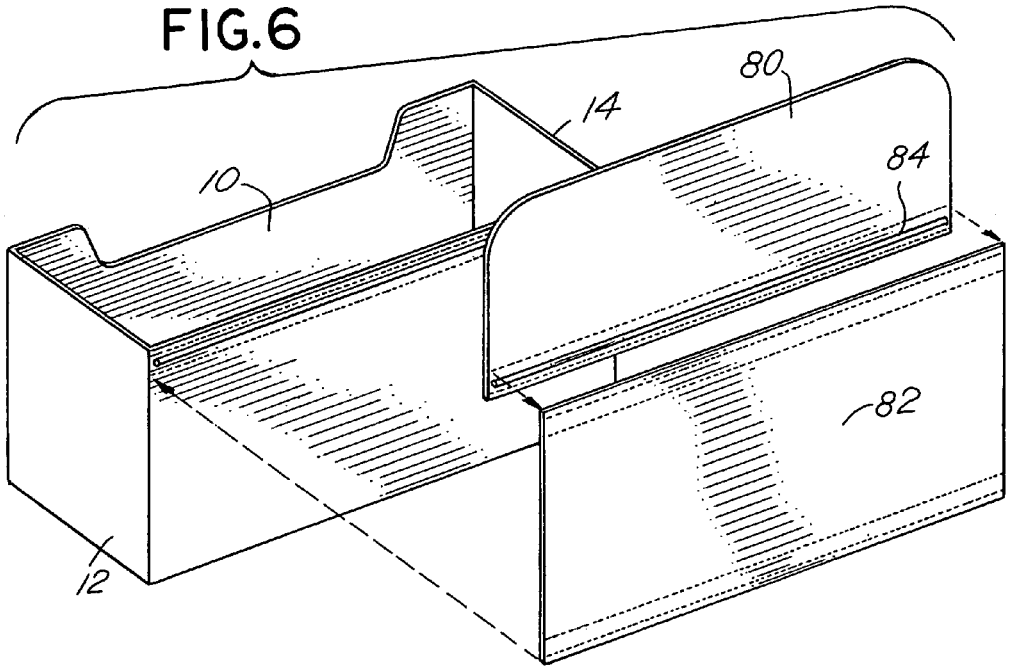

BAG WITH WIRE FRAME CONSTRUCTION

BACKGROUND OF THE INVENTION

In a principal aspect the present invention relates to a carrying case which is made from a flexible fabric material and which includes discrete and separate reinforcing wire frame or rod elements integrated into the carrying case to facilitate maintenance of the shape and form of the case.

Often, a generally rectangular parallelepiped carrying case is fabricated from rigid or boardlike panels that are fastened together in some manner so as to insure the structural integrity and the shape and form of the carrying case. Such carrying cases have multiple uses. For example, they may serve as a carrying case for tools, for documents, or for product samples. Generally, such carrying cases are somewhat expensive because of the necessity for utilizing various complex means and mechanisms to fasten the side members of the case together to form the generally parallelepiped shape of the case. Additionally, such cases typically have little flexibility, thus precluding placement of certain items therein.

Thus, there has developed the need for a carrying case which will maintain its form and shape yet which will achieve a certain degree of flexibility for the purpose of receiving items of unique shape and further for the purpose of being compactable to some extent for storage and/or shipment when empty.

SUMMARY OF THE INVENTION

Briefly, the present invention comprises a rectangular parallelepiped carrying case which is fabricated from a fabric material so that the carrying case is termed a "soft sided" carrying case. The case is constructed, however, in a manner wherein various discrete reinforcing rod members or elements are incorporated in the side panels of the case to maintain the form and configuration of the case thereby enhancing its use. The carrying case includes generally five sides or panels in the form of a rectangular parallelepiped. A bottom side, opposite lateral sides, front and back sides form an open top container. Further, a top side that folds over and encloses the open top to the container or bag is provided. All of the sides are formed from a flexible fabric material. However, discrete elongate wire rods or reinforcing elements are incorporated along or near the top edge of the front and lateral side panels. Additionally, an elongate wire rod is incorporated in the fold over top flap. As a result of this construction, the carrying case achieves and maintains a form and shape which facilitates ease of use.

Thus, it is an object of the invention to provide an improved, soft sided storage and carrying case incorporating discrete wire frame reinforcing elements.

It is a further object of the invention to provide an improved soft sided storage and carrying case wherein discrete wire frame members or reinforcing elements are incorporated along three of the four top side edges of the open top of the carrying case.

Yet another object of the invention is to provide a carrying case made from a flexible or soft fabric material or other similar material which is flexible.

Another object of the invention is to provide a storage and carrying case which incorporates a fabric material as well as discrete reinforcing elements and which is economical, easy to utilize, easy to store, and which is rugged and inexpensive.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is an exploded isometric view illustrating an alternative embodiment and construction of the carrying case of the invention;

FIG. 6 is an exploded isometric view as viewed from the backside of an alternative construction for the carrying case of the invention associated with the embodiment of FIG. 5;

DESCRIPTION OF THE PREFERRED EMBODIMENT

Figure 1:
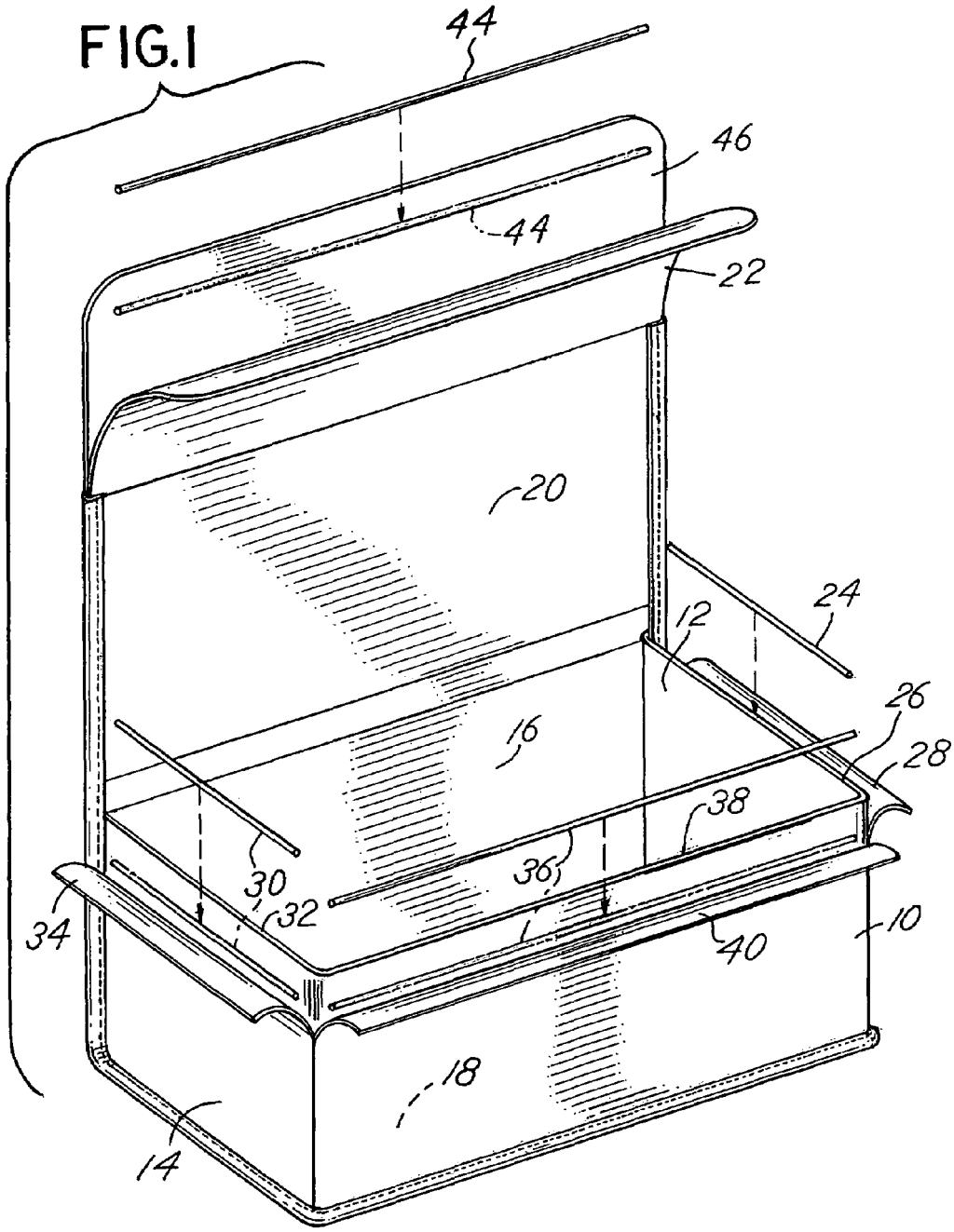
FIG. 1 is an exploded isometric view of the component parts forming the carrying case of the invention.
Figure 2:
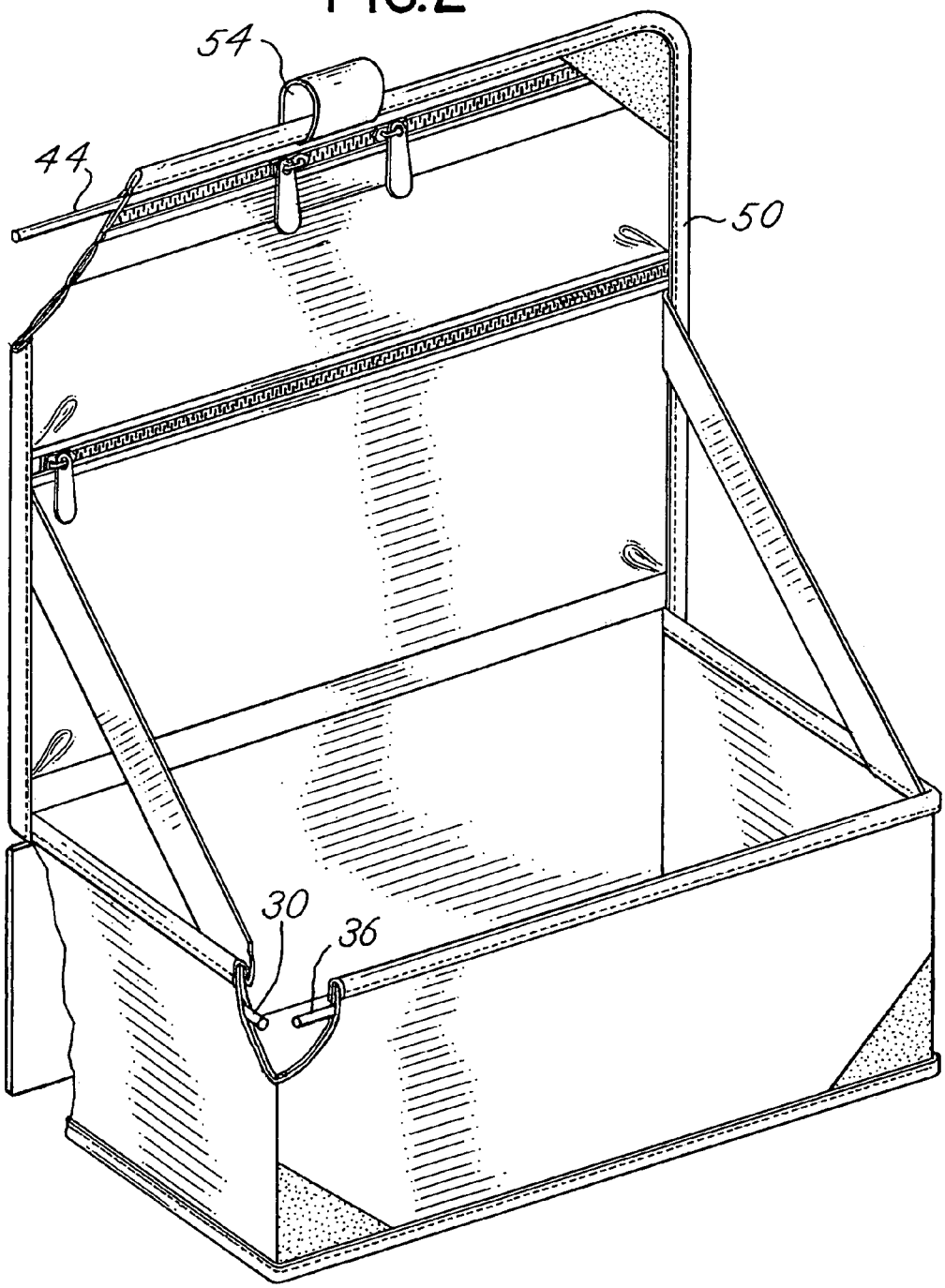
FIG. 2 is an isometric view of the assembled case of FIG. 1.
Figure 3:
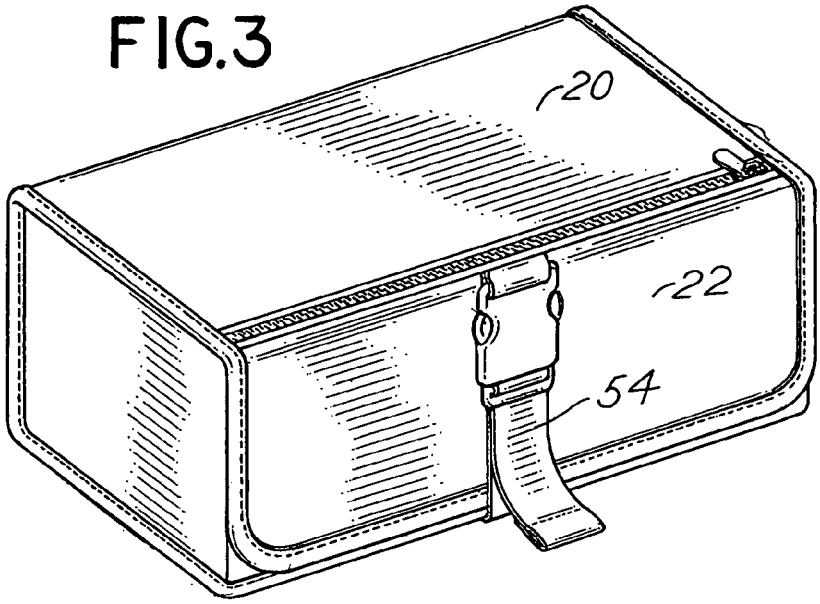
FIG. 3 is an isometric view of the carrying case of FIG. 2 wherein the case has been closed with the top flap thereof moved to the closed position.
Figure 4:
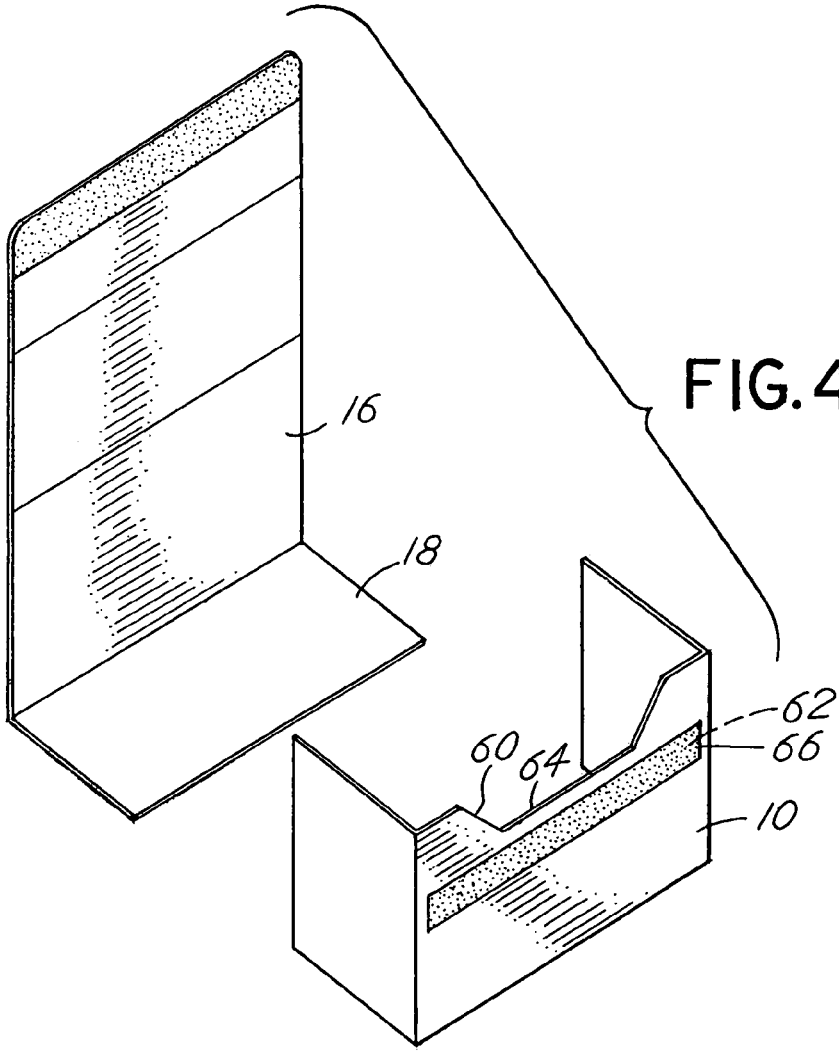
FIG. 4 is a schematic view illustrating the component parts or panels which are assembled to form the carrying case of FIGS. 2 and 3.

FIGS. 1, 2 and 3 as well as FIG. 4 in combination illustrate an embodiment of the invention incorporating fabric material and discrete reinforcing rods, wires or elements in combination therewith to form a carrying case. Referring to those figures, the carrying case of the embodiment of FIGS. 1–4 includes a front panel 10, a first lateral side panel 12, and a second lateral side panel 14 joined with a back side panel 16 and a bottom side panel 18. The panels 10, 12, 14, 16, and 18 are joined together by sewing techniques inasmuch as each of the panels is fabricated from a fabric material or a polymeric material which is flexible and provides a "soft sided" case. Each of the panels 10, 12, 14, 16, and 18 is sized and configured to provide for formation of a rectangular parallelepiped enclosure with an open top.

A top cover panel 20 forms an extension of the back side panel 16 and provides a means for enclosing the open top of the parallelepiped enclosure or case. A cover flap or attachment flap 22 is joined to the top cover flap panel 20. Top cover flap 22 is dimensioned to fit against the front panel 10.

An important aspect of the invention is the utilization of discrete, separate reinforcing rods, wires or rigid elements around or adjacent the top edge or top periphery of the panels forming the enclosure. Thus, a first lateral side wire member 24 is retained along the top edge 26 of the lateral side panel 12 by means of fabric material 28 which is stitched to the panel 12. The wire or rod member 24 is dimensioned to extend substantially the entire distance between the front panel 10 and the back panel 16 and is positioned along or adjacent the top edge 26 of the lateral side panel 12.

In a similar fashion a wire or rod member 30 is retained and maintained along or adjacent the top edge 32 of lateral side panel 14 by means of a fabric layer 34 which is stitched to or fastened to the lateral side panel 14. Note that the supplemental retention panel 34 may be placed on the inside or the outside of the lateral side panel 14. It may comprise a second layer of fabric material which extends over the entire surface of the lateral side panel 14. Alternatively, it may comprise merely an elongate retention panel of fabric which is sized to enclose the rod element or member 30 by being sewn to the lateral side panel 14. Thus, the means of maintaining the wire reinforcing rod 30 along the top peripheral edge 32 of the lateral side panel 14 may vary. In a similar fashion the means for maintaining the rod or wire member 24 may be positioned and retained in any of a number of functional ways. A third wire or rod member 36 extends along or adjacent top edge 38 of top panel 10 between lateral side panels 12 and 14 and is retained in a similar fashion by a flexible fabric panel 40.

The top flap panel 20 is flexibly stitched or attached to back panel 16 or comprises an extension of the back panel 16. A cover flap 22 extension of the top panel 20 may include a wire reinforcing rod 44 retained by a fabric panel 46 stitched to or otherwise attached to the flap 22. The use of the wire or rod member 44 is optional though it is a preferred embodiment.

The combination of the wire rods 24, 30, 36 and 44 with the flexible side panels 12, 14, 18, 22 as described enables the manufacture of a carrying case which retains its form and shape and thus provides an extremely useful case which is soft sided yet which is analogous to, in terms of function, prior art hard sided panel, parallelepiped cases.

FIG. 2 illustrates the construction of the panels described with respect to FIG. 1 wherein the panels are all assembled and binding 50 is provided for fastening the panel members together. FIG. 3 illustrates the construction of FIG. 1 wherein the various panels have been folded together to form a carrying case and wherein a strap member 54 is provided to close the case. FIG. 4 illustrates the various panel members comprising the carrying case of FIGS. 1–3. FIG. 4 also discloses some alternative features of the invention. That is, front panel 10 may include a cut out section 60. In that event, a wire rod member 62 will be retained beneath the lowered edge 64 of the cut out 60 by means of an auxiliary retention panel 66, preferably no more than ⅓ of the height of the bag. This alternative construction is illustrated in further detail in FIG. 5 wherein it is also illustrates that retention flaps or abbreviated panels 68 and 70 are utilized for retention of wire rods 72 and 74 in lateral sides 12 and 14 of the case as depicted by the embodiment of FIGS. 4 and 5.

FIG. 6 illustrates a further alternate feature in the construction of a carrying case of the invention. In FIG. 6 a top cover flap 80 is joined to a back side panel 82 with a wire rod member 84 incorporated in the seam which joins the top flap 80 and the back side panel 82. Thus, the preferred embodiment incorporates wire rods in the front panel 10 as well as the lateral side panels 12 and 14. Additional or alternative wire rod members may be included in the back panel 16 and in the top flap 22. The basic construction, however, utilizes wire rod members in the front panel 10 and lateral side panels 12 and 14 with variations of that approach being depicted, for example, in FIGS. 4, 5 and 6. In each event, the reinforcing elements, rods or wires extend substantially the entire width of the panel to which they are attached.

Figure 7:
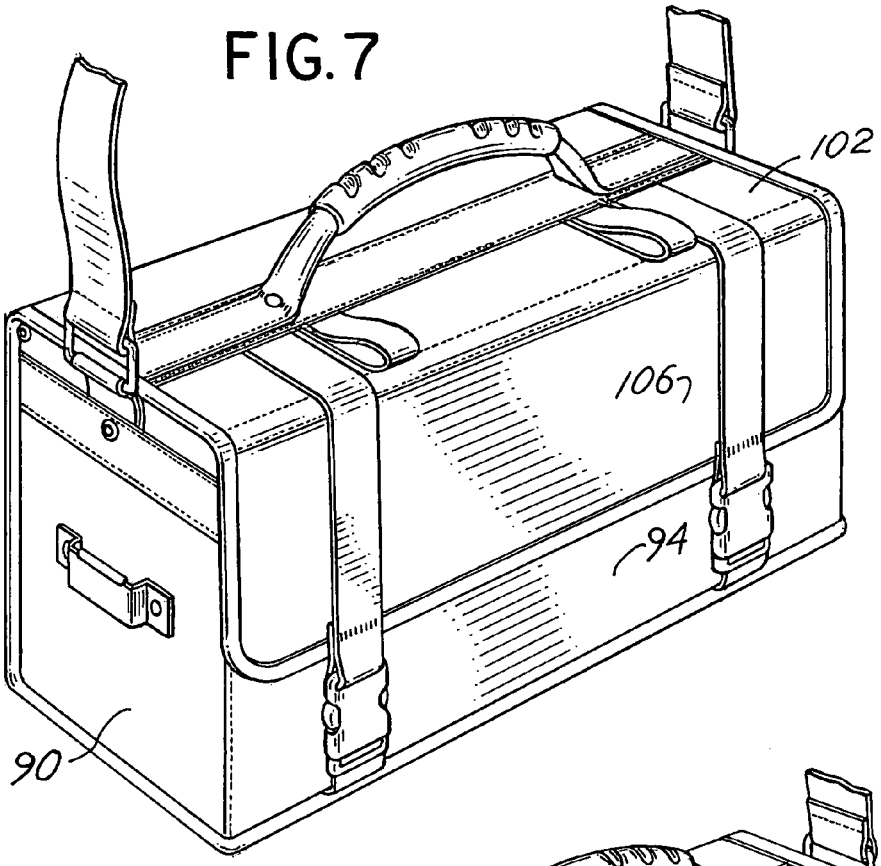
FIG. 7 is an isometric view of an assembled embodiment of the carrying case of the invention incorporating various carrying straps and handles.

FIG. 7 illustrates a carrying case of the type depicted in the prior figures which incorporates wire rod members to provide a formed case.

Figure 8:
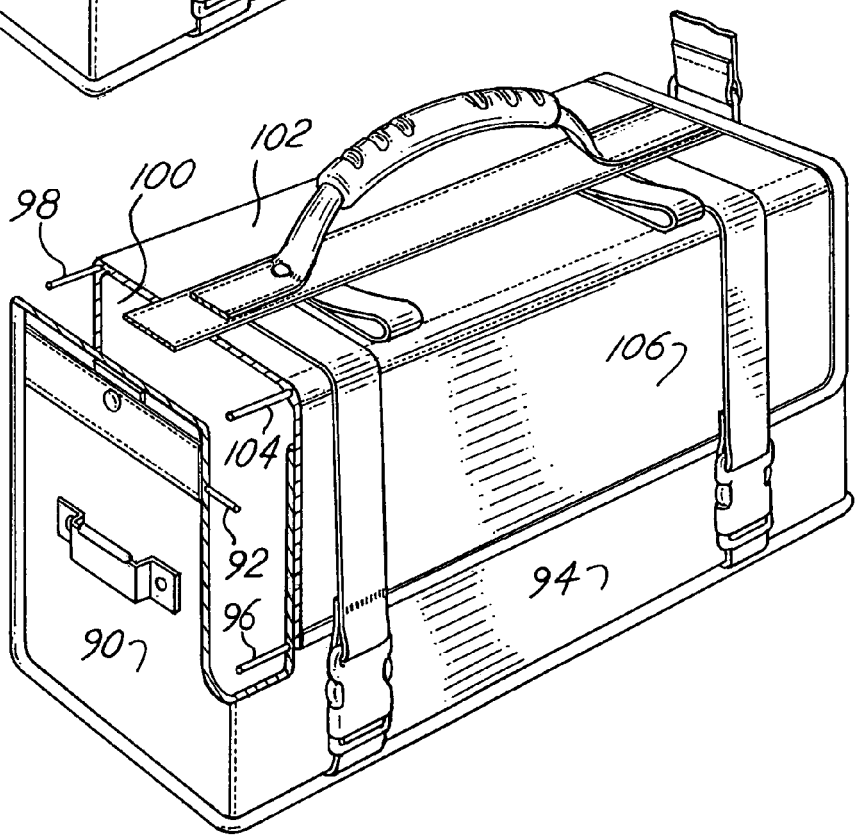
FIG. 8 is an isometric view of the carrying case of FIG. 7 wherein the component parts are partially cut away in section view to illustrate the internal construction of the carrying case.

The embodiment of FIGS. 7 and 8 thus incorporates the structural features of the invention. That is, the panels forming the case are made from a fabric or soft material. The wire or rod members incorporated in the embodiment of FIGS. 7 and 8 are, however, positioned slightly different. Referring to FIGS. 7 and 8, a lateral side panel 90 includes a wire rod member 92 retained adjacent the top peripheral edge. A front panel 94 includes a wire rod member 96 retained below the front peripheral edge and extends from side to side of the carrying case. The carrying case of FIGS. 7 and 8 also includes a wire reinforcing rod (not shown) in the opposite lateral or side panel to the panel 90. The embodiment of FIGS. 7 and 8 further includes a wire rod 98 at the juncture of a backside panel 100 with a top side panel or flap 102. Another wire rod 104 is provided at the juncture of the top flap or panel 102 with a front cover panel 106. In each instance the wire rods 92, 96, 98 and 104 extend the total distance between the sides of the case thus providing a means for reinforcing the panels from side to side.

While there have been set forth a preferred embodiment and embodiments of the invention, the invention is to be limited only by the following claims and equivalents thereof.

What is claimed is:

1. A generally rectangular parallelepiped bag comprising in combination:

a rectangular bottom side panel formed from a flexible material;

a rectangular first side panel formed from a flexible material with a top edge and opposite side edges;

a rectangular second side panel formed from a generally flexible material with a top edge and opposite side edges, said second side panel generally congruent in configuration with said first side panel, parallel thereto and spaced therefrom;

a front side panel formed from a flexible material with a top edge, opposite side edges, and an outside, said top edge including a cut out section;

a rectangular back side panel formed from a flexible material with a top edge and opposite side edges, said back side panel generally parallel to, spaced from and congruent with respect to said front aide panel;

a rectangular top closure side panel formed from a flexible material with an outside, a front edge and opposite side edges;

said first and second side panels joined together to form an enclosure in combination with said front side panel and said back side panel with a top opening formed by the top edges of the first side panel, second side panel, the back side panel and the front side panel;

said top closure side panel having opposite sides and configured to cover and close said top opening in the top side of said enclosure by being folded about a hinge connection between the top closure side panel and back side panel top edge;

a single discreet reinforcing wire rod generally parallel to and incorporated along each of the top edge of the front side panel below the cut out section, the top edge of the first side panel, and the top edge of the second side panel, and the top edge of the back side panel, each said reinforcing rod incorporated in the respective side panel and extending between the side edges thereof, each said wire rod retained by a supplemental layer of fabric material a fixed to the respective panel and enclosing the wire rod, said wire rods thereby maintaining in combination the generally rectangular profile of the top opening of said bag;

said top closure side panel further including a flap extension of flexible material attached to the top closure side panel front edge, said flap foldable aver the outside of the front side panel, said closure flap extension including an outside edge generally parallel to the top closure side panel front edge, and generally parallel opposite lateral sides extending from the opposite sides of the top closure side panel;

a wire reinforcing rod in the flap extension outside edge extending between the lateral sides of the flap extension; and a fastener on the flap extension for attaching the closure flap extension to the front side panel.

* * * * *